US008955563B2

(12) United States Patent
Tahil et al.

(10) Patent No.: US 8,955,563 B2
(45) Date of Patent: Feb. 17, 2015

(54) DEVICE FOR FILLING SOLUBLE CONTAINERS WITH AN IMPROVED ASSEMBLY FOR ORIENTING AND FILLING CAPSULES

(75) Inventors: Raj Vikram Tahil, Maharashtra (IN); Santosh Puransingh Bhagat, Maharashtra (IN); Ajay Virendra Mistry, Maharashtra (IN)

(73) Assignee: Raj Vikram Tahil, Boisar, Thane, Maharashtra (IN)

( * ) Notice: Subject to any disclaimer, the term of this patent is extended or adjusted under 35 U.S.C. 154(b) by 317 days.

(21) Appl. No.: 13/544,694

(22) Filed: Jul. 9, 2012

(65) Prior Publication Data

US 2013/0032246 A1 Feb. 7, 2013

(30) Foreign Application Priority Data

Aug. 4, 2011 (IN) ..... 2214/MUM/2011

(51) Int. Cl.
*B65B 35/56* (2006.01)
*A61J 3/07* (2006.01)

(52) U.S. Cl.
CPC ..... *A61J 3/075* (2013.01); *B65B 35/56* (2013.01); *Y10S 53/90* (2013.01)
USPC ..... 141/237; 141/12; 141/80; 141/248; 141/266; 53/471; 53/281; 53/168; 53/900

(58) Field of Classification Search
USPC ..... 141/12, 80, 234, 237, 248, 266; 53/471, 53/281, 168, 900
See application file for complete search history.

(56) References Cited

U.S. PATENT DOCUMENTS

| | | | | |
|---|---|---|---|---|
| 1,567,639 | A * | 12/1925 | Eastman | 141/246 |
| 2,680,548 | A * | 6/1954 | Karos | 141/246 |
| 5,321,932 | A * | 6/1994 | Sundberg | 53/468 |
| 5,836,141 | A * | 11/1998 | Sundberg | 53/468 |
| 7,234,494 | B2 * | 6/2007 | Tahil et al. | 141/237 |
| 7,337,596 | B2 * | 3/2008 | Barrett et al. | 53/531 |
| 7,530,213 | B2 * | 5/2009 | Barrett et al. | 53/531 |
| 2005/0076969 | A1 * | 4/2005 | Tahil et al. | 141/165 |
| 2006/0248857 | A1 * | 11/2006 | Senesi | 53/281 |
| 2007/0130890 | A1 * | 6/2007 | Barrett et al. | 53/468 |
| 2008/0163590 | A1 * | 7/2008 | Barrett et al. | 53/281 |
| 2013/0014471 | A1 * | 1/2013 | Tahil et al. | 53/284.5 |

* cited by examiner

*Primary Examiner* — Nicolas A Arnett
(74) *Attorney, Agent, or Firm* — Brinks Gilson & Lione

(57) ABSTRACT

A device for filling soluble containers is provided. The device includes an assembly for orienting capsules comprising a sheet component having a top sheet, a bottom sheet and a sliding sheet adapted to move between the top and bottom sheets. The top sheet includes slots for accommodating capsules, and the bottom sheet includes notches adapted to orient the capsules into a filling position. In a first position, the slots in the sliding sheet align with the slots in the top sheet. In a second position, the slots in the sliding sheet align with the notches in the bottom sheet. The assembly also includes a base component for guiding the oriented capsules therethrough. The base component can have an antistatic sheet fastened to the bottom surface. The sheet component can be loose fitted to the base component. An assembly for filling capsules is also provided.

7 Claims, 15 Drawing Sheets

120a

120b

120a

120b

DEVICE FOR FILLING SOLUBLE CONTAINERS WITH AN IMPROVED ASSEMBLY FOR ORIENTING AND FILLING CAPSULES

CROSS-REFERENCE TO RELATED APPLICATIONS

This application claims priority to India Patent Application No. 2214/MUM/2011, filed on Aug. 4, 2011, the entirety of which is hereby incorporated by reference.

FIELD OF THE INVENTION

The present invention relates to a device for filling soluble containers such as capsules.

BACKGROUND

Generally, it is known that a device for filling soluble containers such as capsules includes an assembly for orienting capsules, an assembly for filling capsules and accessories including a powder tray and a powder spreader. The assembly for orienting capsules can orient the capsules in such a way that caps remain up and bodies in down position. The orienters known in the art can be hand held or bench top assembly for orienting capsules.

Typically, the assembly for orienting capsules can include a sheet component and a base component to which the sheet component is fastened. The sheet component of the orienter assembly generally includes a top sheet for loading the capsules and a bottom sheet for orienting the capsules. U.S. Pat. No. 7,234,494 discloses an invention entitled "device for filling soluble containers" wherein the device for filling soluble containers includes an assembly for orienting and separating capsules and an assembly for filling the capsules. The U.S. Pat. No. 7,234,494 patent discloses a hand held assembly for orienting capsules having a sheet component for orienting capsules and a base component for guiding the oriented capsules. The sheet component has a top sheet for loading the capsules and a bottom sheet for orienting the capsules loaded therein and the sheets capable of being relatively displaced with respect to each other. Slots are provided in the top sheet for limiting such displacement by setting free configuration for orientation of the capsules. The U.S. Pat. No. 7,234,494 patent further describes that an open closable gate is mounted to the top sheet for enabling easier loading and containment of the capsules within the top sheet, for orienting the capsules. The sheet component is usually configured as a sub-assembly and is capable of being used as a change-part in pre-assembled condition.

The capsules to be filled can be poured into the sheet such that each slot in the sheet houses a capsule. Orientation of the capsules can be initiated by horizontally sliding the top sheet to align the slots of the top sheet with that of the bottom sheet causing the capsules in the top sheet to fall into the slots of the bottom sheet and further into the orienter base for orienting the capsules into filling position.

Typically, the sheet component is either screw fitted or snap fitted to the orienter base using a screw. Therefore, each time, the size of the capsules to be filled is changed, the change-part is unscrewed or released from the orienter base and another change-part according to the required size is re-screwed to the orienter base. The orienter change part along with the orienter base becomes a heavy assembly creating fatigue to the operator. Furthermore, often the capsules get stuck to the base due to the static force during orientation.

Typically, the assembly for filling capsules known in the art such as described in U.S. Pat. No. 7,234,494 has a sheet component with a top sheet, bottom sheet and a sliding sheet and each of the sheets having plurality of holes therein to allow passage of capsules there through for holding the capsules for facilitating separation into the body portion and the cap portion. Further, it has been disclosed that the sliding sheet can be displaceable relative to the top and bottom sheets for effecting gripping of a portion of the capsules during separation of the capsules. Further, the base component has a cam assembly mounted on it for effecting relative displacement of the sheets.

The assembly for filling capsules, particularly double blind capsules are known to be provided with profile notches to accommodate such double blind capsules such as described in U.S. Pat. No. 7,234,494. However, providing such profile notches reduces the number of capsules separated and filled per cycle.

The assembly for orienting capsules can be hand held or a bench top assembly. The bench top assembly for orienting capsules known in the art generally includes a base with a transfer chute and sliding arrangement for capsule tray loading plate, rectification assembly with finger plate, orienter change parts and a transfer plate.

The object of the present invention is to provide an improved handheld assembly for orienting capsules that can orient more number of capsules at a time. Another object of the invention is to provide a handheld assembly for orienting the capsules having tool free and screw free change parts and can be easy to handle.

Another object of the present invention is to provide an assembly for filling double blind capsules such that more number of capsules can be filled at a time.

Another object of the invention is to provide a bench top assembly for orienting capsules which can be easy to handle and can orient large range of sizes of capsules.

Another object of the present invention is to provide a method of orienting caps.

SUMMARY OF THE INVENTION

According to one embodiment of the invention, a device for filling soluble containers is provided. The device according to the present invention can include an assembly for orienting capsules and an assembly for filling capsules. The assembly for orienting capsules can include at least one sheet component for orienting capsules and at least one base component for guiding the oriented capsules there through. The sheet component can include at least one top sheet, a bottom sheet and a sliding sheet adapted to move in between the top sheet and the bottom sheet from a first position to a second position. The top sheet and sliding sheet can include plurality of slots for accommodating the capsules loaded thereto. The bottom sheet can include plurality of notches adapted to orient the capsules into the filling position. The slots in the sliding sheet in a first position can align with the slots in the top sheet and the slots in sliding sheet in a second position can align with the notches in the bottom sheet. Thus the present invention provides an improved handheld orienter assembly that can orient more number of capsules per cycle.

The base component can have an antistatic sheet fastened to the bottom surface of the base component. The antistatic sheet can be made of stainless steel. The base component can further include a groove having a fastener locating hole on the top surface and the sheet component can include a fastener that can enter the locating hole such that the sheet component can be loose fitted to the base component. The fastener according to one embodiment can be a screw bush. The loose fitted sheet component eliminates the need of handling the handheld orienter assembly along with the base component thus making it light weight and easy to handle.

According to another embodiment of the present invention a device for filling capsules can be provided. The device for filling soluble capsules can include an assembly for orienting capsules and an assembly for filling capsules. The assembly for filling capsules can include a sheet component for holding a body portion of capsules thereby facilitating separation of a body portion and a cap portion of the capsules resulting in separated capsules, and a base component for supporting a body portion of the separated capsules. The sheet component can have a top sheet and at least two sliding sheets, first sliding sheet located below the top sheet and adapted to move relative to the top sheet; and a second sliding sheet located below said first sliding sheet and adapted to move relative to the first sliding sheet. Each of the sheets can have a plurality of holes therein to allow passage of capsules there through for holding a portion of each of the capsules for facilitating separation into the body portion and the cap portion; said top sheet having a spacer with groove fastened on its bottom surface such that the sliding sheets move within the groove; said sheet component is fastened to said base component. Each of the sheet component can have a thickness of about 1 mm and can be fastened with screws in the centre of the sheet component.

Thus, the present invention provides an assembly for filling capsules where the sheet component can accommodate and fill more number of double blind capsules.

According to another embodiment of the present invention, a bench top assembly for orienting capsules is provided. The bench top assembly can include a base, a capsule tray loading plate, a transfer plate, a rectification assembly and the orienter sheet component for orienting capsules of size range 00 to 4. The transfer plate according to the present invention can have plurality of holes wherein the holes are concentric to the capsule loading tray hole and transfer chute path profile. The diameter of the holes can be dimensioned with minimum clearance between capsules cap outer diameter and inside diameter of holes. The holes (232) can be provided with a guide (228) at an angle of about 60 degree for guiding the capsules from the orienter sheet component (206) to the hole (232). The guide (228) can be funnel shaped and can direct the capsules from the sheet component (206) to the hole (232) preventing bouncing of capsules from the hole (232). The guide (232) can be provided preferably at the entrance of the hole (232).

The holes (232) can further be provided with a guide (230) at an angle of about 90 degree for accommodating and transferring the capsules from the transfer plate hole (232) to capsule loading tray mounted on the capsule tray loading base plate (204).

The rectification assembly includes a finger plate having plurality of finger profiles wherein the finger can have a width dimension from 14 to 15 mm, preferably 15 mm. The fingertip can have a height from 14 mm to 16 mm, preferably about 15.2 mm. The finger plate can have a working height from 30 mm to 31 mm, preferably 30.5 mm. The fingerplate can have a width to working height ratio of about 1:2.1.

In one embodiment of the invention, the bench top device having the transfer plate with the guide (228) and (230) and the finger plate having a finger profile width dimension of about 15 mm and finger profile tip height of about 15.2 mm can orient capsule sizes 00 to 4. The width to height ratio of such finger plate can be about 1:1.05. The present invention thus provides a bench top orienter that can orient capsule sizes 00 to 4.

According to another embodiment of the present invention, a method of orienting capsules is provided, said method includes the steps of providing a sheet component having at least one top sheet, a bottom sheet and a sliding sheet adapted to move in between the top sheet and the bottom sheet from a first position to a second position. Loading plurality of capsules in the top sheet keeping the sliding sheet in the first position such that the sliding sheet aligns with the top sheet positioning the capsules in at least two layers, a top layer and a bottom layer. Causing the capsules in the bottom layer to fall in the notches of the bottom sheet and orienting the capsules in the bottom layer to a filling position by moving the sliding sheet from the first position to the second position. Dropping the capsules in the top layer to the bottom layer by moving the sliding sheet from second position to said first position and orienting the capsules in the bottom layer by moving the sliding sheet from the first position to the second position

DETAILED DESCRIPTION OF THE DRAWINGS

The present invention provides a device for filling capsules having an assembly for orienting capsules and an assembly for filling capsules. In another embodiment of the present invention, a bench top assembly for orienting capsules is provided.

Figure 1:
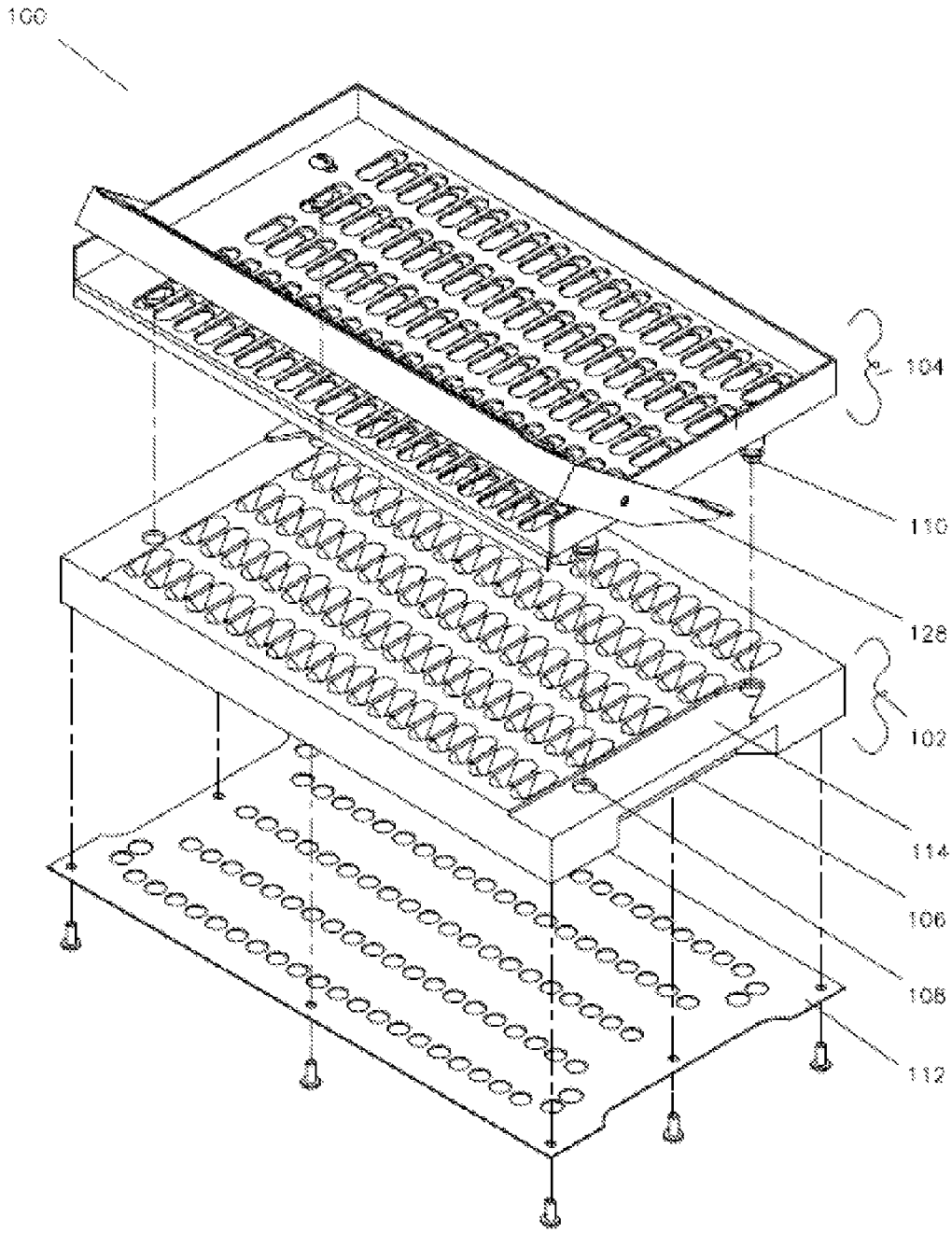
FIG. 1 shows an exploded view of an assembly for orienting capsules according to the present invention.
Figure 2:
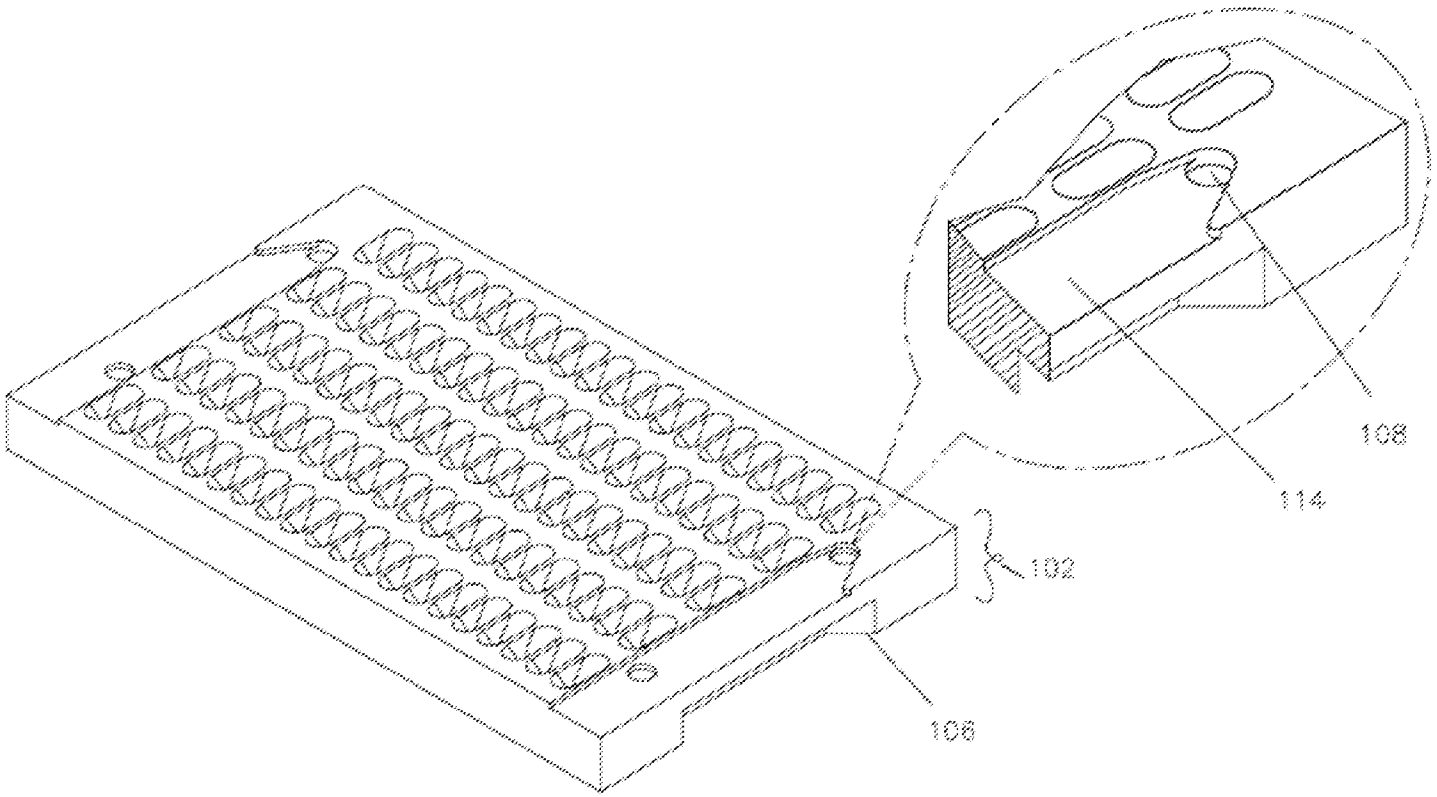
FIG. 2 shows an isometric view of an orienter base according to the present invention.
Figure 3A:
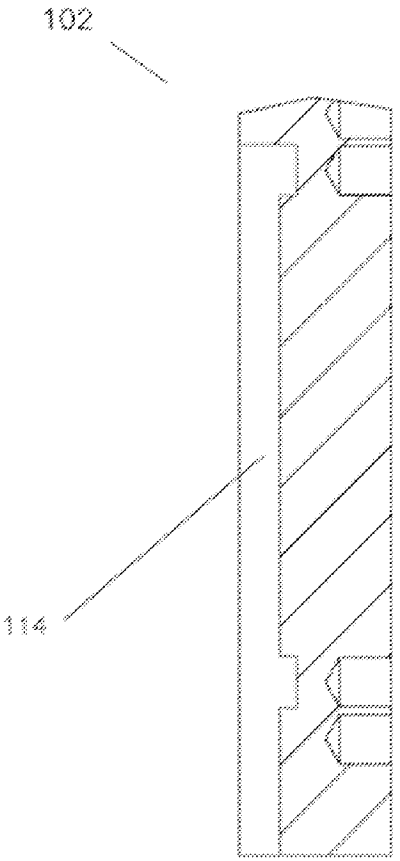
FIG. 3A shows the cross-sectional view of the orienter base of FIG. 3 along A-A.
Figure 3:
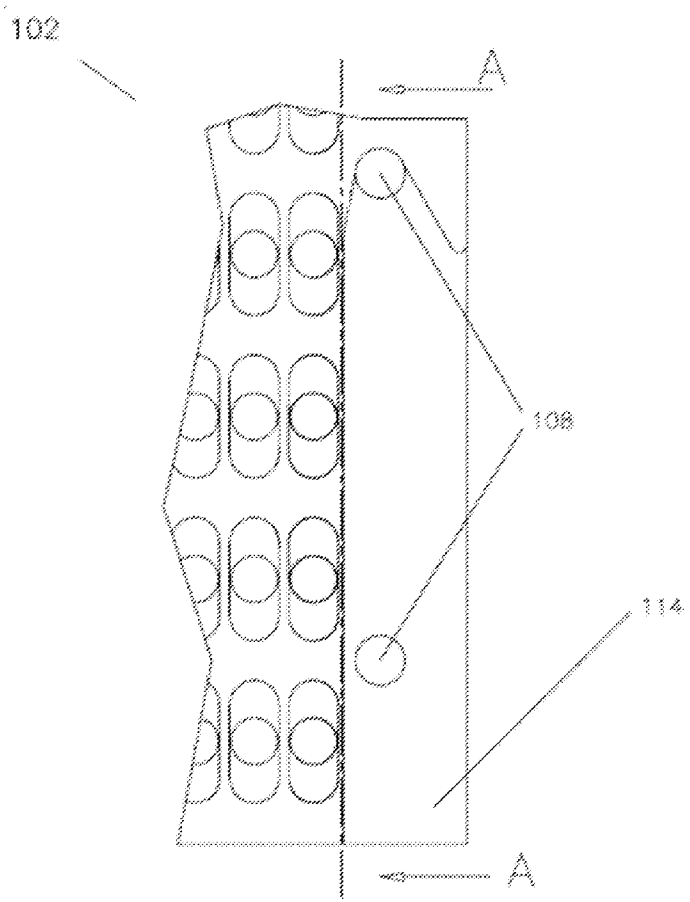
FIG. 3 shows a top view of an orienter base showing groove and locating holes according to the present invention.

According to one embodiment of the present invention, the device for filling capsules can include an improved assembly for orienting capsules (100) having a base component (102) and a sheet component (104) supported over the base component (102) (FIGS. 1 and 2). The sheet component (104) can be referred to as orienter change part (104). The base (102) has a pair of cut outs (106) for hand gripping. The base component (102) can include a groove (114) having fastener locating holes (108) on the top surface for accommodating and locating a fastener (110) of the orienter change part or sheet component (104) (FIGS. 3 and 3A) such that the sheet component (104) can be loose fitted over the base component (100). The fastener (110) according to the present invention can be a screw bush (110) as shown in FIG. 3. Alternatively, pins, screws, bars can be used instead of screw bush to loosely fit the sheet component (104) over the base component (100).

The base component (102) can be provided with an antistatic sheet (112) that can be fastened on the bottom surface of the orienter base (102) (FIG. 1). The antistatic sheet can be made of stainless steel. Generally, the base component (102) can be made of plastic material and it is known in the art that the capsules remain stuck occasionally at the bottom of the base due to static during orientation of the capsules. The antistatic sheet (112) prevents the sticking of capsules to the base while orienting the capsules. The antistatic sheet (112) can be made of other conductive material such as for example aluminum, copper, or brass.

Figure 4:
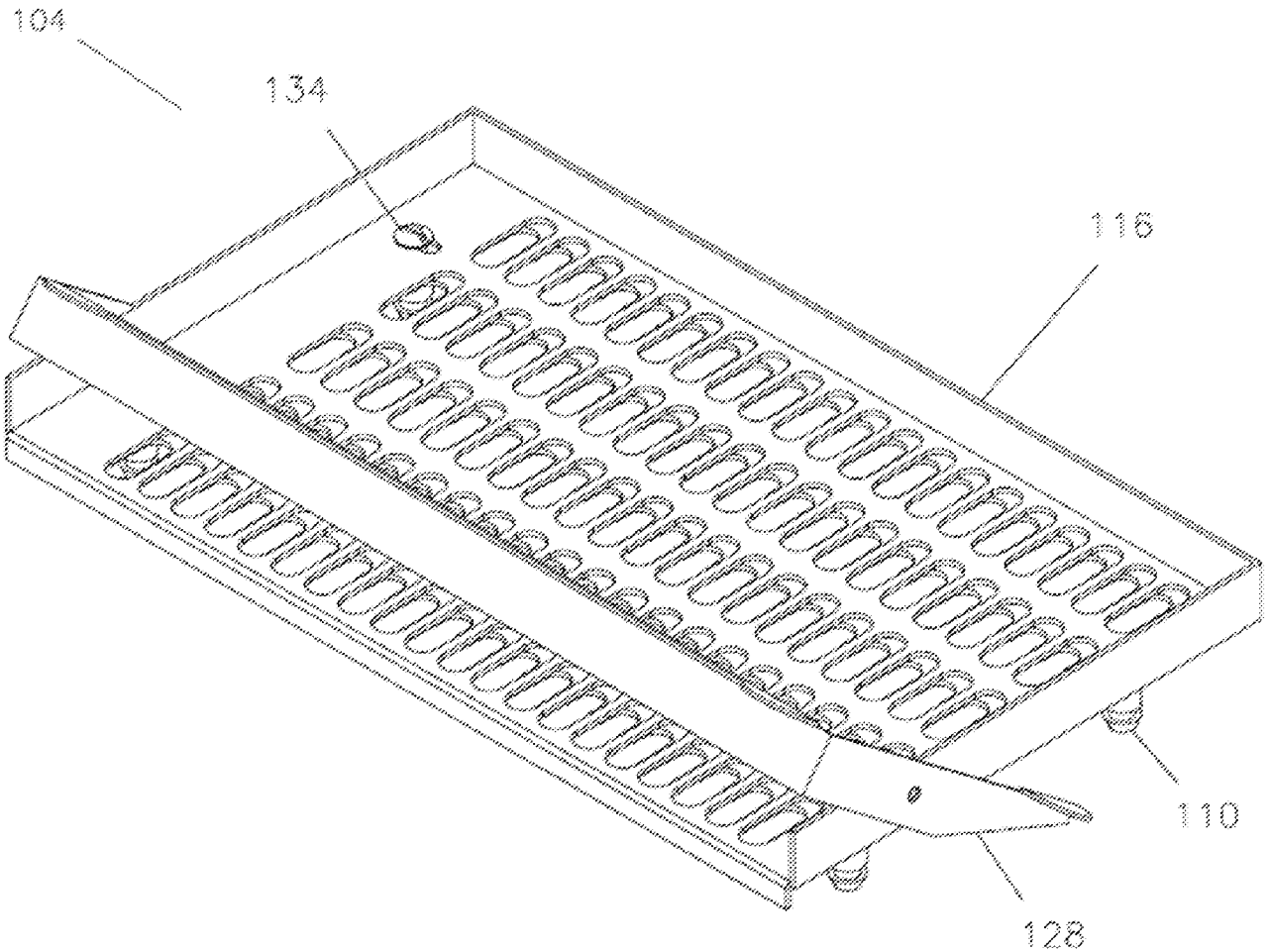
FIG. 4 shows an isometric view of an orienter change part according to the present invention.
Figure 5:
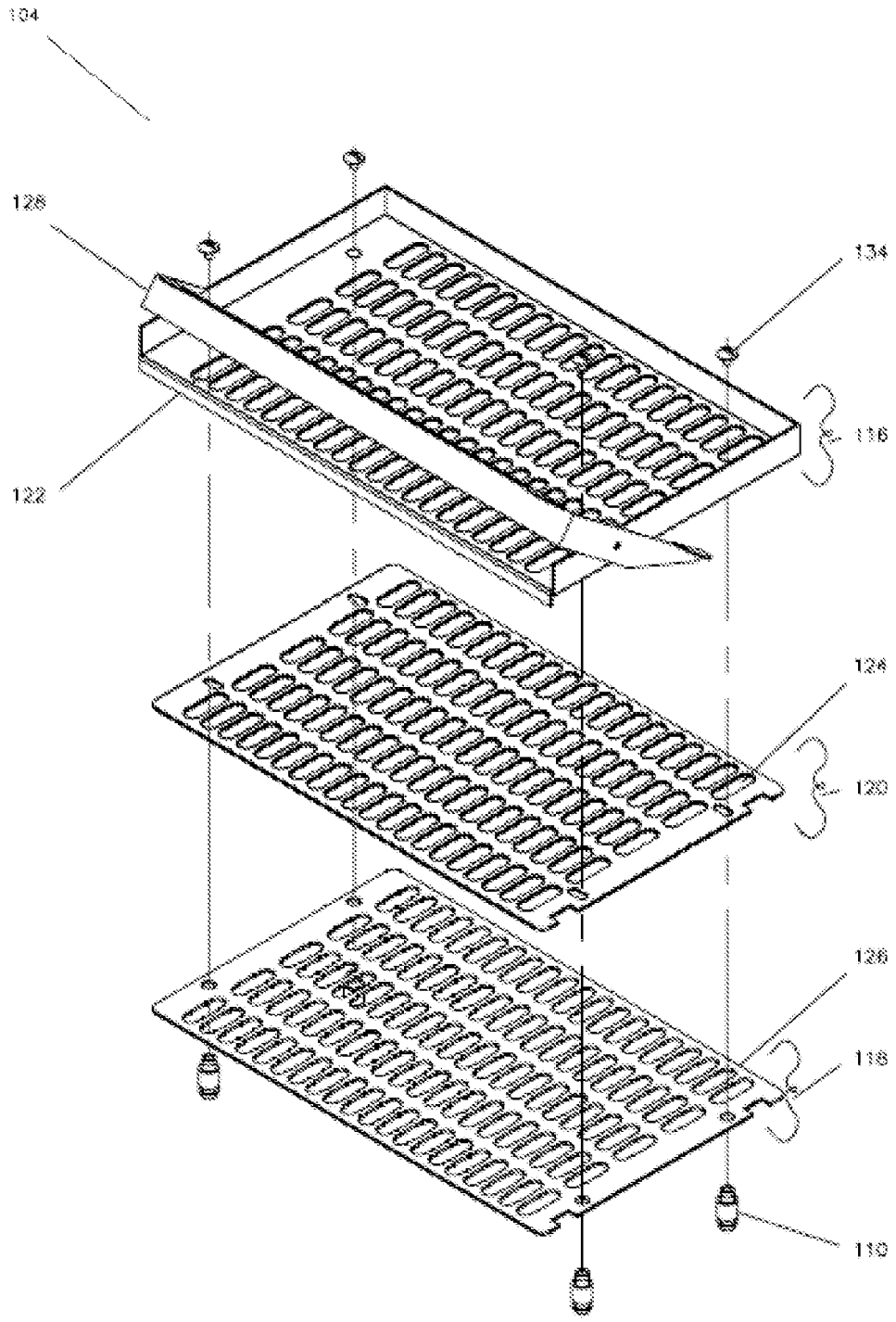
FIG. 5 shows an exploded view of an orienter change part according to the present invention.
Figure 6A:
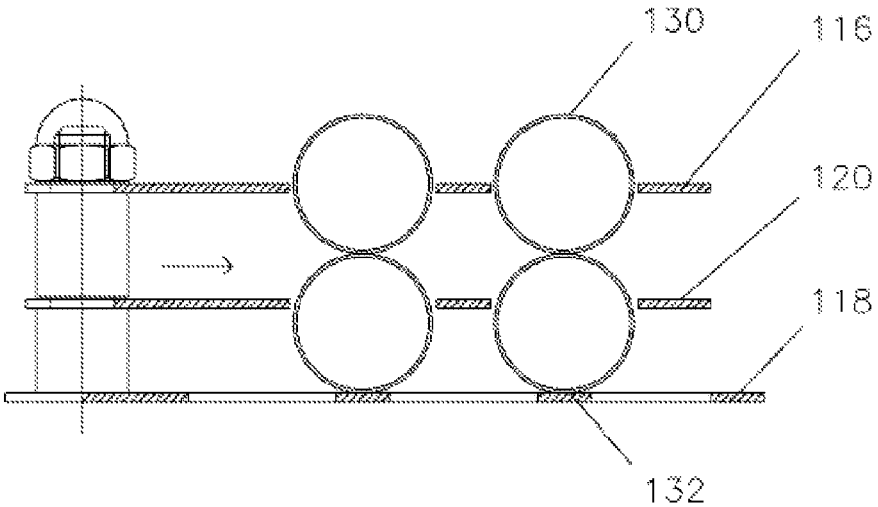
FIGS. 6A-D show a front view of the one stage loading and two-step orientation of the capsules according to the present invention.
Figure 6B:
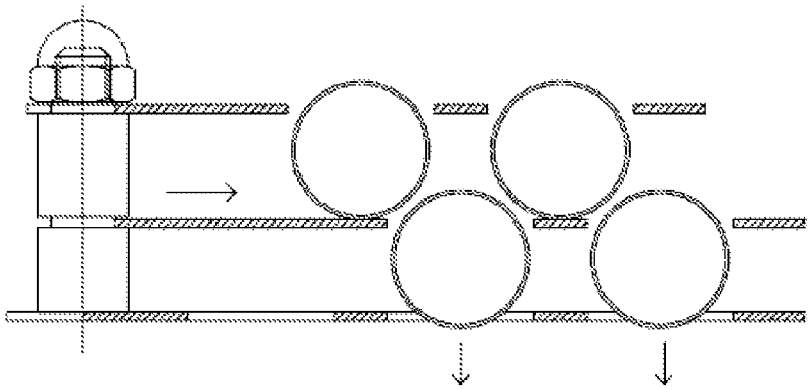
Figure 6C:
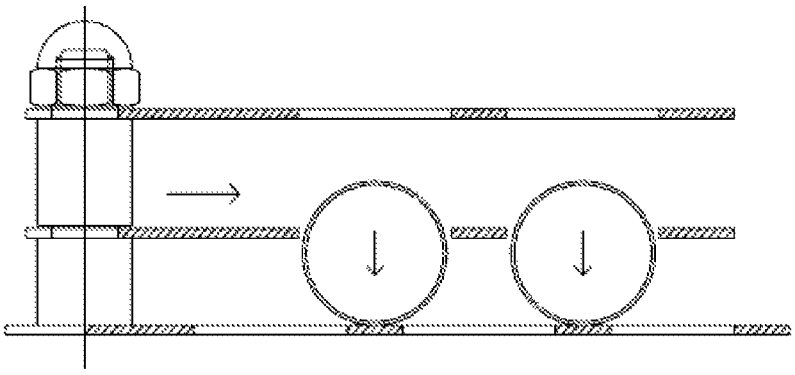
Figure 6D:
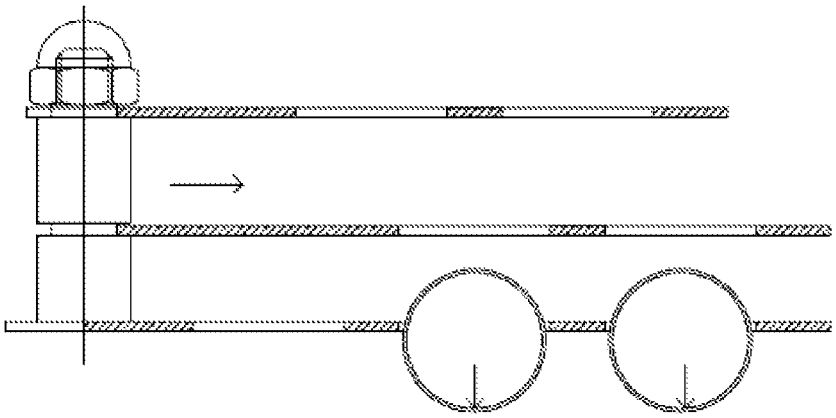

The sheet component or the orienter change part (104) according to the present invention is shown in FIGS. 4 and 5. The sheet component (104) can include at least three sheets, a top sheet (116), a bottom sheet (118) and a sliding sheet (120), which can be adapted to move in between the top sheet (116) and the bottom sheet (118).

The top sheet (116) and the sliding sheet (120) can be provided with plurality of slots (122) and (124) for accommodating the capsules on loading. The bottom sheet (118) can be provided with notches (126) for orienting capsules. The three sheets (116), (118) and (120) are assembled together using four screw bushes (110) and a top screw (134). The screw bush (110) may be provided with a groove.

According to one embodiment of the present invention, the sheet component (104) can also be used to orient double blind capsules. The sliding sheet (120) (FIGS. 6A-6D) can be adapted to move forward from a first position (120*a*) to a second position (120*b*) and backward from second position (120*b*) to the first position (120*a*). In the first position (120*a*), the slots (124) in the sliding sheet (120) can be aligned with the slots (122) in the top sheet (116) and the notches (126) in the bottom sheet can be offset to the slots (124) in the sliding sheet (120). In the second position (120*b*), the slots (124) can be aligned with the notches (126) of the bottom sheet.

The capsules can be loaded on the top sheet (116) such that each slot (122) in the top sheet (116) and each slot (124) in sliding sheet (120) can house a capsule. Extra capsules that are not occupying the slot (122) can be removed from the top sheet through an openable gate (128) hinged to the top sheet (116), as shown in FIG. 4. The capsules can be loaded in the top sheet (116) in at least two layers a top layer (130) and a bottom layer (132) below the top layer (130) keeping the sliding sheet (120) in the first position (120*a*). The capsules in the top layer (130) can be seated in the slot (122) of the top sheet (116). The capsules in the bottom layer (132) can be seated on the bottom sheet (118) such that they do not fall in the notches (126). As shown in FIGS. 6A-6D, orientation of capsules in two layer can be done in two steps, moving the sliding sheet (120) from the first position (120*a*) to the second position and (120*b*) causing the capsules in the bottom layer (132) to fall in the notches (126) for orienting the capsules in the bottom layer (132) in the filling position, moving the sliding sheet (120) from the second position (120*b*) to the first position (120*a*) causing the capsules in the top layer (130) to fall to the bottom layer (132); moving the sliding sheet (120) from first position (120*a*) to the second position (120*b*) causing the capsules in the bottom layer (132) to fall in the notches (126) for orienting the capsules in the bottom layer. Thus, the three-sheet orienter change part (104) can orient more number of capsules loading the capsules in one stage and orienting the capsules in two steps reducing the cycle time for orienting more number of capsules. It can be understood that to orient more number of capsules in one stage loading, the number of top sheet (116) can be increased.

The sheet component (104) can be loose fitted over the base component (102). The screw bushes (110) can enter the screw bush locating holes (108) on the groove (114) provided on the base component (102) (FIGS. 1 and 3). Thus, the loose fitted assembly for orienting capsules would be tool or screw free, which reduces the change over time of sheet component. Furthermore, it can also reduce the handling weight of the orienter assembly, which makes it convenient for the operator. The improved orienter assembly of the present invention can be a hand held orienter.

Figure 10:
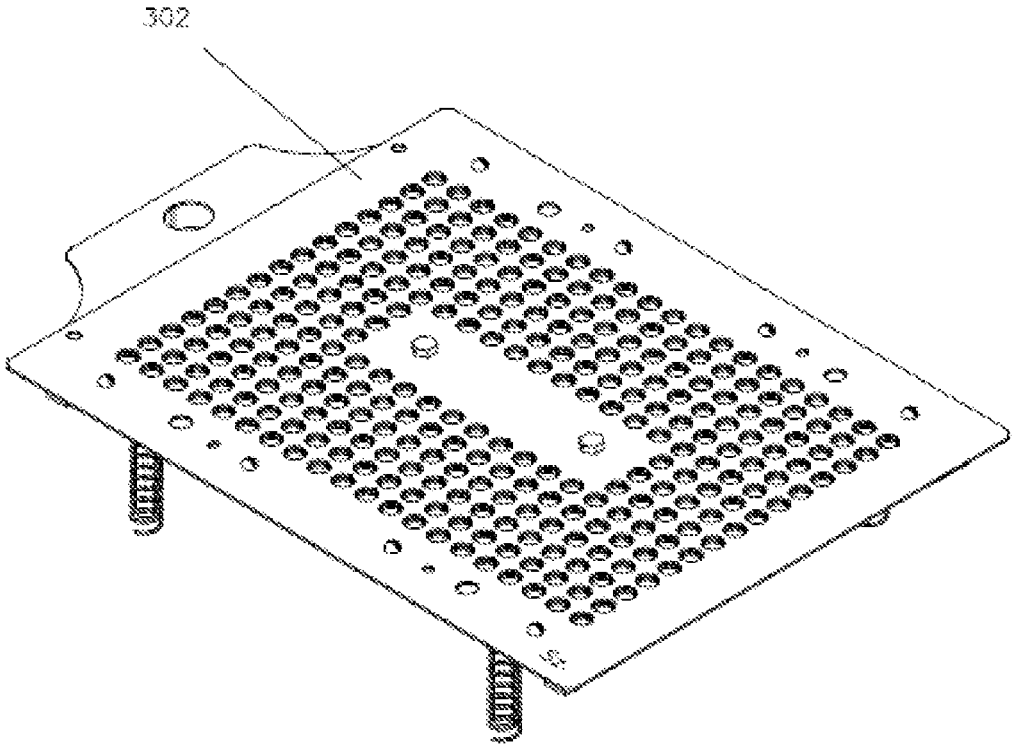
FIG. 10 shows an isometric view of the sheet component of the assembly for filling double blind capsules according to the present invention.
Figure 10A:
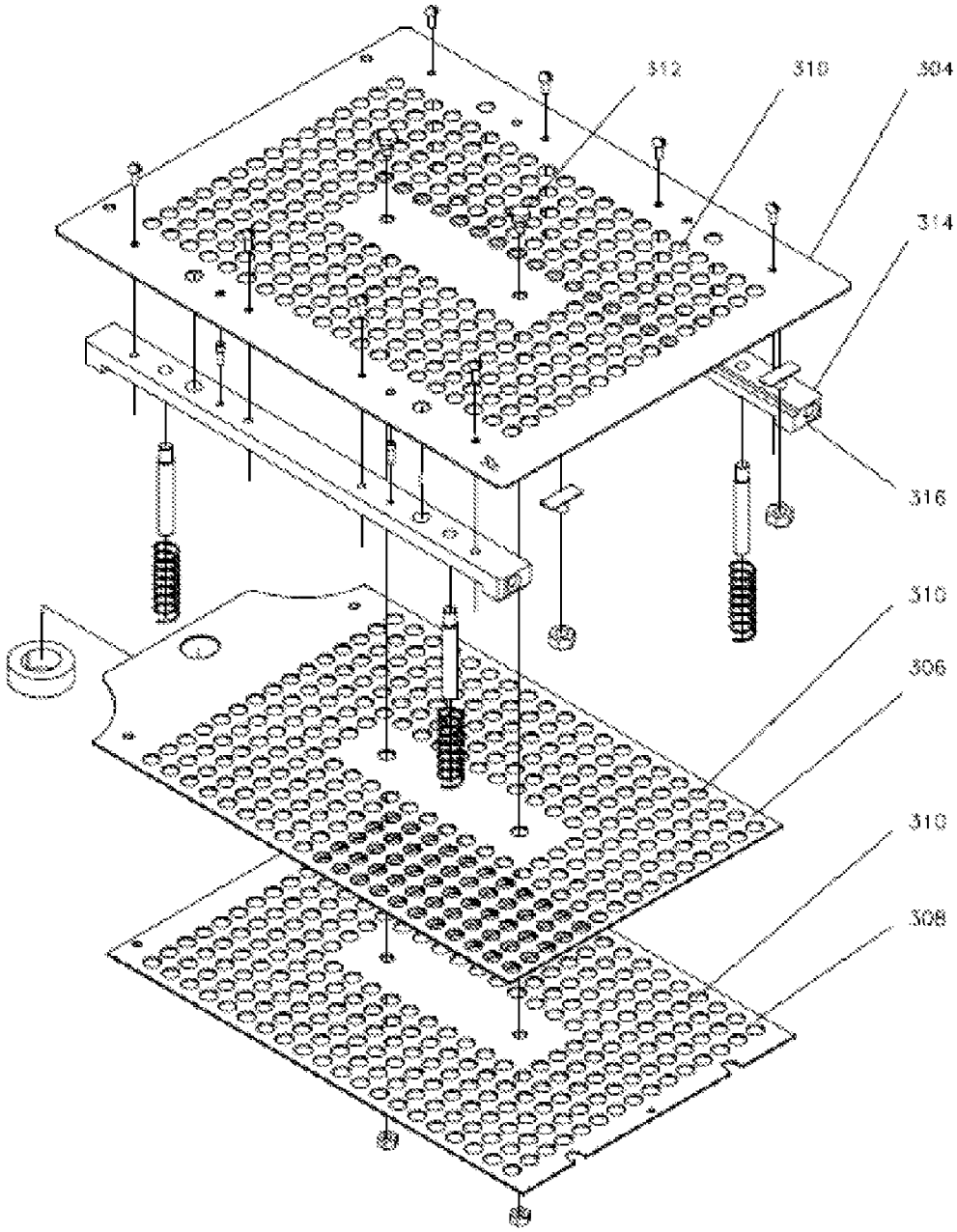
FIG. 10A shows an exploded view of the sheet component of FIG. 10.
Figure 10B:
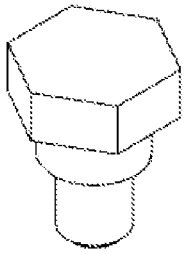
FIG. 10B shows a close up of the screws of the sheet component of FIG. 10.
Figure 11:
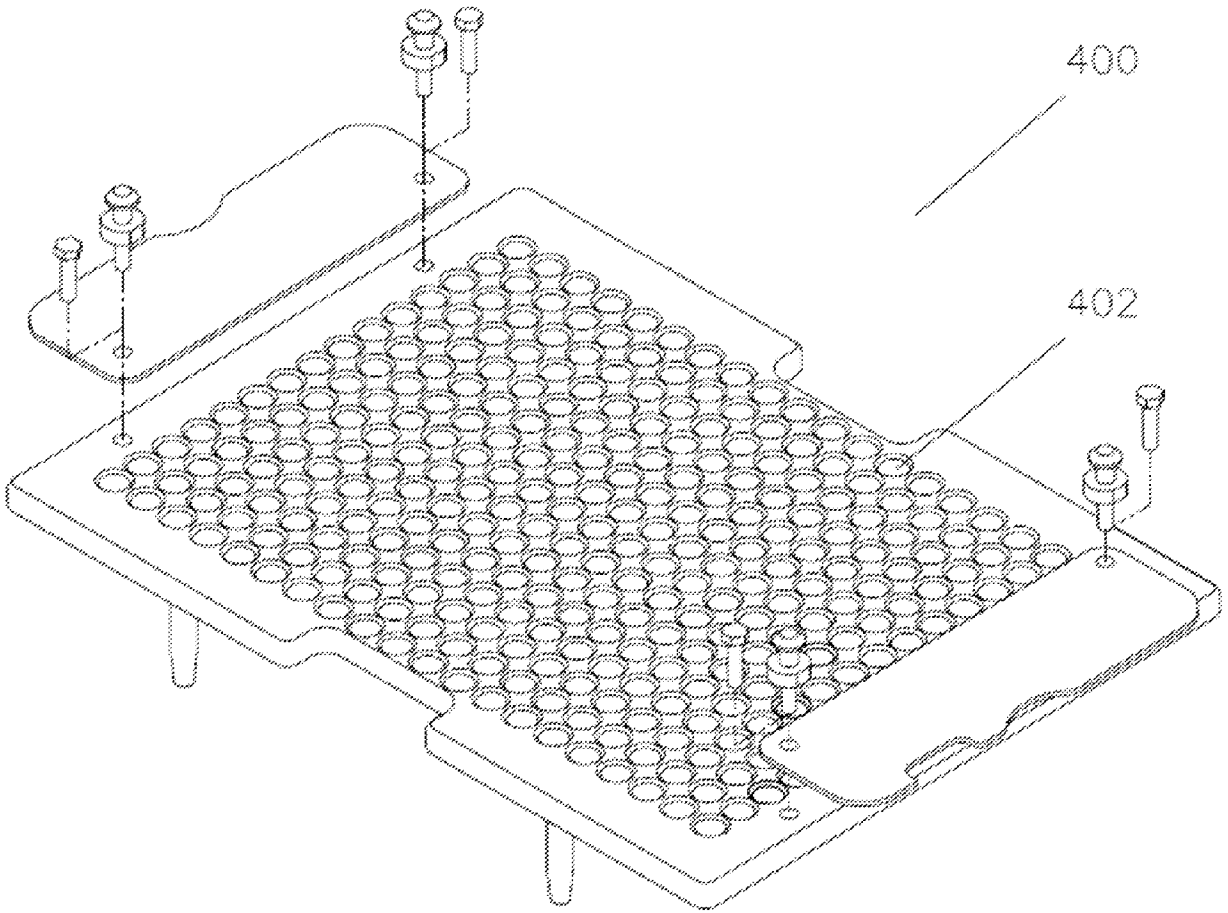
FIG. 11 shows an isometric view of the capsule loading tray assembly according to the present invention.

Another embodiment of the present invention provides a device for filling capsules, particularly double blind capsules comprising an assembly for orienting capsules according to the present invention as shown in FIGS. 10 and 11 and an assembly for filling capsules (300) (FIG. 10). The assembly for filling double blind capsules (300) can include a sheet component (302) having a top sheet (304) and two sliding sheets (306) and (308), first sliding sheet (306) located below the top sheet (304) which can be adapted to move relatively to the top sheet (304) and a second sliding sheet (308) located below the first sliding sheet (306) adapted to move relatively to the first sliding sheet (304) (FIGS. 10 and 10A). Each of the sheet components (304, 306 and 308) can have plurality of holes (310) therein to allow passage of capsules there through for holding a portion of each of the capsules for facilitating separation into a body portion and cap portion. Each of the sheet components (304, 306 and 308) can have a thickness of about 1 mm. The sheet component (302) can be fastened with screws (312) in the centre of the sheet component (302). The centre screws (312) (FIG. 10B) can provide strength to the sheet component and prevent bending of the sheet component (302) while separating and filling double blind capsules.

The assembly for filling capsules (300), particularly double blind capsules according to the present invention can separate and fill more number of capsules. The holes (310) provided on the sheet component (302) are regular holes and thus can accommodate more number of holes in a sheet and hence more number of double blind capsules for example 270 capsules.

Figure 10C:
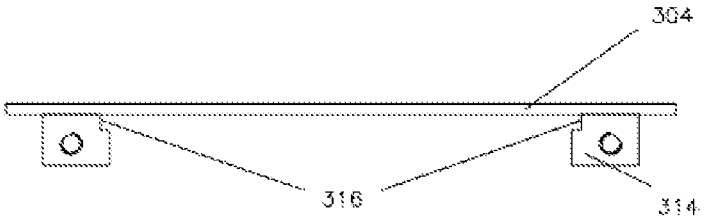
FIG. 10C shows a side view of the top sheet of the sheet component of FIG. 10.

The top sheet (304) can have a spacer sheet (314) having spacer grooves (316) (FIG. 10C) fastened to the bottom surface of the top sheet (304) thereby providing a gap between the top sheet (304) and the sliding sheets (306 and 308) enabling the relative movement of the sliding sheets (306 and 308) through the spacer groove (316) on the bottom surface of the top sheet (304).

The sheet component (304) can be supported over a base frame as known to a person skilled in the art. The sheet component for filling capsules (304) can be used on a hand held and a bench top device for filling capsules.

The assembly for filling can further include a capsule loading tray as known to a person skilled in the art. The capsules are loaded on the capsule tray and excess capsules are removed from the capsule loading tray before placing it on the filler.

Figure 7:
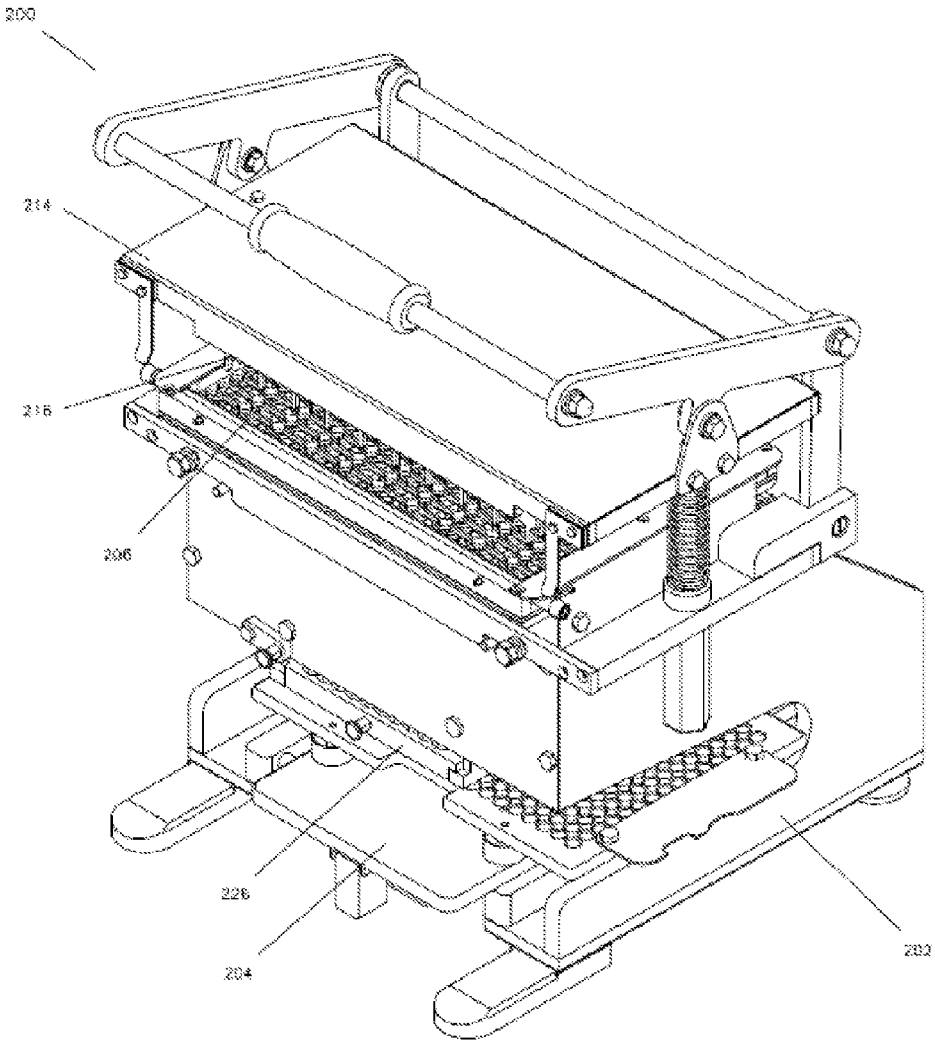
FIG. 7 shows an isometric view of a bench top orienter assembly according to the present invention.
Figure 8B:
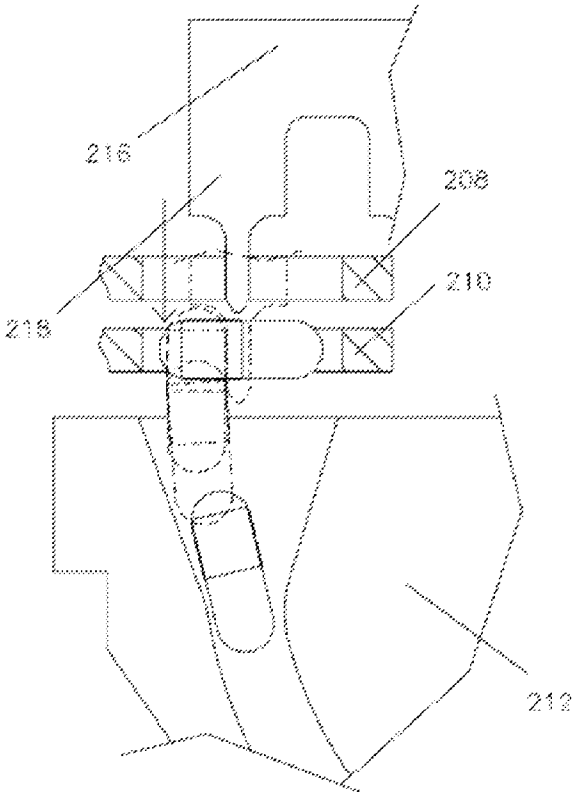
FIG. 8B shows a front view close-up of the finger plate of FIG. 8A.
Figure 8A:
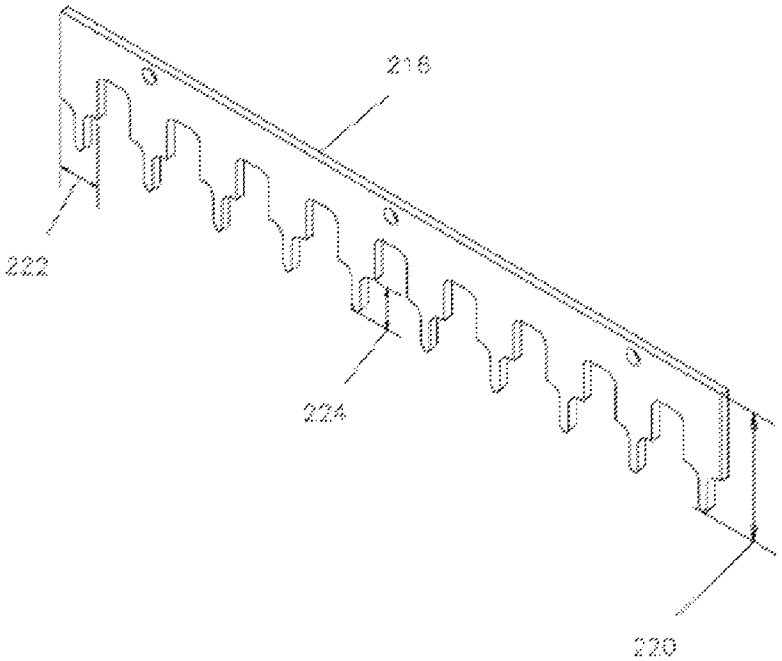
FIG. 8A shows an isometric of the finger plate according to the present invention.
Figure 9:
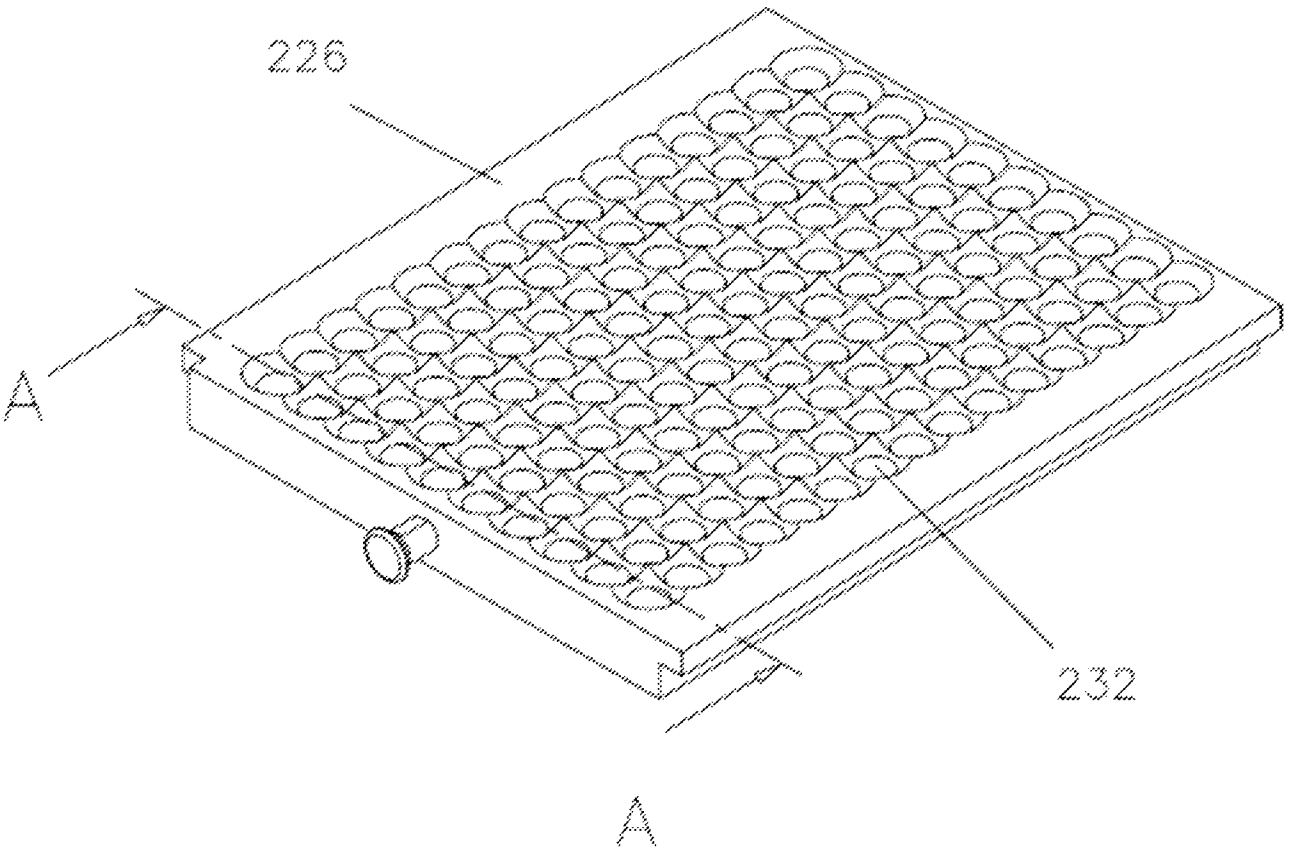
FIG. 9 shows an isometric view of a transfer plate according to the present invention.

Another embodiment of the invention provides a bench top orienter (200) having the orienter change parts according to the present invention having a base (202), sheet component (206) a capsule tray loading plate (204), a rectification assembly (214), and a transfer plate (226), according to the present invention for orienting different size ranging from 00 to 4. (FIGS. 7 to 9). The sheet component (206) can have plurality of slots for accommodating the capsules. A person skilled in the art would understand that the position of the slots could be modified to match the holes in the assembly for filling capsules of the present invention.

The base (202) can include a transfer chute for guiding the oriented capsules assembled and supported by the two support plates on the base (202) (FIG. 7). The base (202) can further include a linear guide sliding arrangement adapted to move in X-axis and Y axis that can hold and move the capsule tray loading plate (204) while orientation of capsules.

Figure 9A:
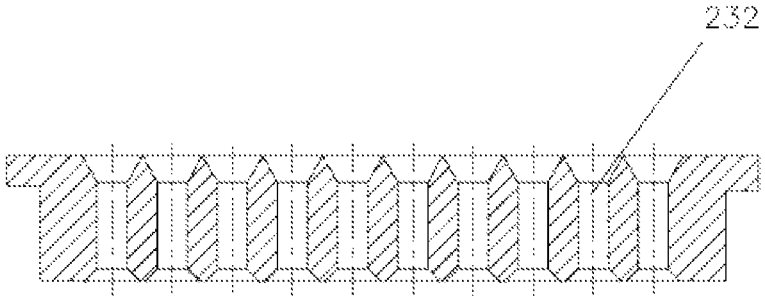
FIG. 9A shows the cross-sectional view of the transfer plate of FIG. 9 along A-A.
Figure 9B:
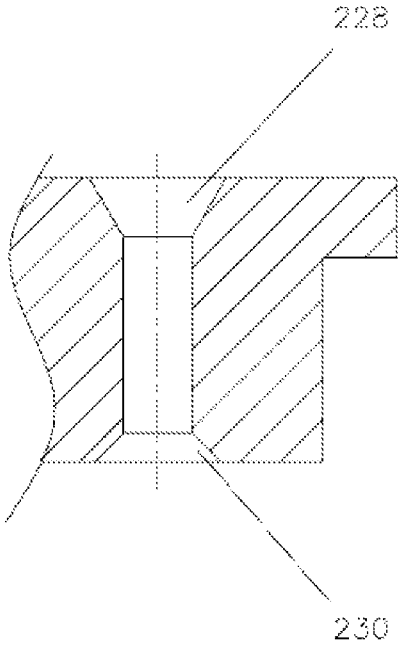
FIG. 9B shows a close up view of the holes of the transfer plate of FIG. 9.

A transfer plate (226) can be located below the transfer chute (212) and can include plurality of holes (232) (FIG. 9) for transferring the capsules. Generally, the transfer plate can be a change part depending upon the size of the capsule being oriented. The holes (232) in transfer plate (226) can have a profile diameter such that capsules of different diameter and length can be accommodated and guided into the holes (FIGS. 9A and 9B). Each hole (232) in the transfer plate (226) at the bottom can be concentric to holes (402) on the capsule loading tray (400) (FIG. 11) mounted and located in position on the capsule loading tray base plate (204) and hole (232) in the transfer plate at the top can be concentric to transfer chute path profile. Typically, the capsules while falling from the sheet component (206) to the transfer plate through transfer chute can bounce and turn upside down, or fall off-centered outside the hole on the capsule loading tray (400) and may cause damage to the capsules. Hence it is very difficult to operate the capsule of size range (00-4) on same orienter base.

The holes (232) can be provided with a guide (228) at an angle of about 60 degree for guiding the capsules from the orienter sheet component (206) to the hole (232). The guide (228) can be funnel shaped and can direct the capsules from the sheet component (206) to the hole (232) preventing bouncing of capsules from the hole (232). The guide (232) can be provided preferably at the entrance of the hole (232).

The holes (232) can further be provided with a guide (230) at an angle of about 90 degree for accommodating and transferring the capsules from the transfer plate hole (232) to the capsule loading tray (400) mounted on the capsule tray loading base plate (204). The guide (230) can be funnel shaped and can direct the capsules from the transfer plate to the capsule tray loading base. The guide (230) can prevent the damage of the capsules during removal of capsule loading tray (400) if the capsule has not entered fully inside the holes (402) on the capsule loading tray (400).

The rectification assembly (214) can include a finger plate (216) (FIGS. 8A-8B) having plurality of finger profiles that can enter the slots in the bench top orienter top sheet (208) pushing the capsules from top sheet slots into the slot of orienter bottom sheet (210) while orienting and pushing the capsules in transfer chute (212). The finger profile (218) can have a width dimension about 15 mm. The finger profile tip can have a height (224) dimension in the about 14 to 16 mm, preferably of about 15.2 mm. The finger profile can have working height (220) about 30 to 31 mm, preferably of about 30.5 mm. The finger plate (216) can have a width to working height ratio of 1:2.1.

In one embodiment of the invention, the bench top device having the transfer plate (226) according to the present invention provided with the guide (228) and (230) at the entrance and the exit of the hole (232) and the finger plate having a finger profile width dimension of about 15 mm and height of about 15.2 mm can orient capsule sizes 00 to 4. The width to height ratio of such finger plate can be about 1:1.05. The advantage of the present invention is that it can orient capsules of 6 different sizes.

In another embodiment of the present invention, a method for orienting capsules can be provided said method includes providing a sheet component comprising at least one top sheet, a bottom sheet and a sliding sheet adapted to move in between the top sheet and the bottom sheet from a first position to a second position, loading plurality of capsules in the top sheet (116) such that the capsules in the top layer (130) can be seated in the slots (122) in the top sheet (116) The capsules in the bottom layer (132) can be oriented by moving the sliding sheet (120) from first position (120*a*) to a second position (120*b*) and causing the capsules in the bottom layer (132) to fall in the notches (126) of the bottom sheet (118). The capsules in the top layer (130) can be dropped to the bottom layer (132) by moving the sliding sheet (120) from the second position (120*b*) to the first position (120*a*). The capsules in the bottom layer (132) can be oriented by moving the sliding sheet (120) from first position (120*a*) to a second position (120*b*) (FIG. 6). Thus, the present invention provides a method of orienting capsules whereby more number of capsules can be oriented by loading the capsules in one stage and orienting the capsules in two steps. The method of the present invention can thus reduce the time consumed for orienting n-number of capsules.

It is understood that the invention is not limited to the embodiments set forth herein for the purpose of exemplification, but is to be limited only by the scope of the attached claims including the full range of equivalency to which each element thereof is entitled.

the invention claimed is:

1. A device for filling soluble containers comprising:

an assembly for orienting capsules; and an assembly for filling capsules;

wherein the assembly for orienting capsules comprises at least one sheet component for orienting capsules and at least one base component for guiding the oriented capsules therethrough;

wherein the sheet component comprises at least one top sheet, a bottom sheet and a sliding sheet adapted to move in between the top sheet and the bottom sheet from a first position to a second position;

wherein the top sheet and sliding sheet comprises a plurality of slots for accommodating the capsules loaded thereto;

wherein said bottom sheet comprises a plurality of notches adapted to orient the capsules into a filling position;

wherein the slots in the sliding sheet in a first position align with the slots in the top sheet; and wherein the slots in the sliding sheet in a second position align with the notches in the bottom sheet.

2. The device according to claim 1, wherein the base component comprises an antistatic sheet fastened to a bottom surface of the base component.

3. The device according to claim 2, wherein the antistatic sheet can be a stainless steel sheet or an antistatic coating.

4. The device according to claim 1, wherein the base component comprises a groove having a fastener-locating hole on a top surface; and wherein the sheet component comprises a fastener that can enter the fastener-locating hole such that the sheet component is loose fitted over the base component.

5. The device according to claim 4 wherein the fastener is a screw bush.

6. A device for filling capsules comprising:

an assembly for orienting capsules, and an assembly for filling capsules, wherein the assembly for filling capsules comprises:

a sheet component for holding a body portion of capsules thereby facilitating separation of a body portion and a cap portion of the capsules resulting in separated capsules; and a base component for supporting a body portion of the separated capsules;

wherein the sheet component comprises:

a top sheet and at least two sliding sheets, a first sliding sheet located below the top sheet and adapted to move relative to the top sheet; and a second sliding sheet located below the first sliding sheet and adapted to move relative to the first sliding sheet, wherein each of the sheets has a plurality of holes therein to allow passage of capsules therethrough for holding a portion of each of the capsules for facilitating separation into the body portion and the cap portion;

wherein the top sheet has a spacer with groove fastened on its bottom surface such that the sliding sheets move within the groove;

wherein the sheet component is fastened to the base component; and wherein each sheet of the sheet component has a thickness of about 1 mm and is fastened with screws in a centre of the sheet component.

7. A method of orienting capsules, the method comprising:

providing a sheet component comprising at least one top sheet, a bottom sheet and a sliding sheet adapted to move in between the top sheet and the bottom sheet from a first position to a second position;

loading a plurality of capsules in the top sheet keeping the sliding sheet in the first position such that the sliding sheet aligns with the top sheet, positioning the capsules in at least two layers, a top layer and a bottom layer;

causing the capsules in the bottom layer to fall in a plurality of notches of the bottom sheet and orienting the capsules in the bottom layer to a filling position by moving the sliding sheet from the first position to the second position;

dropping the capsules in the top layer to the bottom layer by moving the sliding sheet from the second position to the first position; and orienting the capsules in the bottom layer by moving the sliding sheet from the first position to the second position.

* * * * *

UNITED STATES PATENT AND TRADEMARK OFFICE

CERTIFICATE OF CORRECTION

PATENT NO. : 8,955,563 B2
APPLICATION NO. : 13/544694
DATED : February 17, 2015
INVENTOR(S) : Raj Vikram Tahil et al.

It is certified that error appears in the above-identified patent and that said Letters Patent is hereby corrected as shown below:

In the Claims

In column 8, claim 1, line 54, before "bottom sheet comprises" replace "said" with --the--.

Signed and Sealed this
Fifteenth Day of September, 2015

Michelle K. Lee

Michelle K. Lee
*Director of the United States Patent and Trademark Office*